US011564294B2

(12) United States Patent
Cumpston et al.

(10) Patent No.: US 11,564,294 B2
(45) Date of Patent: Jan. 24, 2023

(54) DRIVERS WITH SIMPLIFIED CONNECTIVITY FOR CONTROLS

(71) Applicant: Bridgelux, Inc., Fremont, CA (US)

(72) Inventors: Brian Cumpston, Pleasanton, CA (US); Shiva Rai, Fremont, CA (US); Linden Willis-Kilgroe, San Jose, CA (US); Sudeep Reddy Dodda, San Jose, CA (US)

(73) Assignee: Bridgelux, Inc., Fremont, CA (US)

( * ) Notice: Subject to any disclaimer, the term of this patent is extended or adjusted under 35 U.S.C. 154(b) by 0 days.

(21) Appl. No.: 17/670,766

(22) Filed: Feb. 14, 2022

(65) Prior Publication Data

US 2022/0167475 A1 May 26, 2022

Related U.S. Application Data

(63) Continuation of application No. 17/228,013, filed on Apr. 12, 2021, now Pat. No. 11,265,984, which is a (Continued)

(51) Int. Cl.
*H05B 45/20* (2020.01)
*H05B 45/30* (2020.01)
(Continued)

(52) U.S. Cl.
CPC ..... *H05B 45/20* (2020.01); *F21V 23/001* (2013.01); *F21V 23/004* (2013.01); *F21V 23/06* (2013.01); *H05B 47/19* (2020.01); *F21Y 2115/10* (2016.08)

(58) Field of Classification Search
CPC ..... H05B 45/20; H05B 45/30; H05B 45/325; H05B 45/46; H05B 47/10; H05B 47/175; H05B 47/18; H05B 47/19
See application file for complete search history.

(56) References Cited

U.S. PATENT DOCUMENTS 8,212,485 B2 * 7/2012 Elek ..... H05B 47/19 700/286
9,538,593 B2 1/2017 Zhang
(Continued)

FOREIGN PATENT DOCUMENTS

| | | | |
|---|---|---|---|
| CA | 2950632 | A1 | 7/2016 |
| EP | 3182800 | A1 | 6/2017 |
| WO | 2016068688 | A1 | 5/2016 |

OTHER PUBLICATIONS

International Search Report, PCT/US2020/020741.
Written Opinion, PCT/US2020/020741.

*Primary Examiner* — Thai Pham
(74) *Attorney, Agent, or Firm* — CrossPond Law

(57) ABSTRACT

A method of controlling an LED system with a control signal having a first control scheme may include providing a lighting module including a control module, an LED driver connected to the control module, and at least one LED connected to the LED driver; receiving, at the control module, the control signal having a first control scheme; comparing the first control scheme to a predetermined second control scheme; when the comparing determines that the first control scheme is the same as the predetermined second control scheme, transmitting to the LED driver a driver control signal including the predetermined second control scheme; and when the comparing determines that the first control scheme is different from the predetermined second control scheme, translating, with the control module, the first control scheme into the predetermined second control scheme and then transmitting to the LED driver a driver control signal including the predetermined second control scheme.

20 Claims, 7 Drawing Sheets

Related U.S. Application Data continuation of application No. 16/292,607, filed on Mar. 5, 2019, now Pat. No. 11,006,492.

(51) Int. Cl.

| | |
|---|---|
| ***H05B 47/19*** | (2020.01) |
| ***F21V 23/00*** | (2015.01) |
| ***F21V 23/06*** | (2006.01) |
| *F21Y 115/10* | (2016.01) |

(56) References Cited

U.S. PATENT DOCUMENTS

| | | | | |
|---|---|---|---|---|
| 9,595,880 | B2 * | 3/2017 | Knode | H05B 47/175 |
| 10,314,124 | B1 * | 6/2019 | Yang | H05B 45/50 |
| 10,314,132 | B1 * | 6/2019 | Wilde | H05B 45/20 |
| 2013/0193873 | A1 * | 8/2013 | Isaacson | H05B 45/20 315/294 |
| 2014/0122930 | A1 * | 5/2014 | Devale | G06F 11/0709 714/37 |
| 2014/0152188 | A1 * | 6/2014 | Bora | H05B 47/19 315/210 |

* cited by examiner

DRIVERS WITH SIMPLIFIED CONNECTIVITY FOR CONTROLS

CROSS REFERENCE TO RELATED APPLICATIONS

This patent application is a continuation of U.S. patent application Ser. No. 17/228,013, filed on Apr. 12, 2021, which in turn is a continuation of U.S. patent application Ser. No. 16/292,607, filed on Mar. 5, 2019, all of which are hereby incorporated by reference in their entirety.

FIELD OF THE INVENTION

The present application relates generally to drivers, and more particularly to drivers with control modules that allow multiple forms of control options.

BACKGROUND

Drivers are essentially regulators of power acting between what they are driving and a power source. They ensure that there are no significant fluctuations within either the current or the voltage being delivered to that being driven. One particularly important application of drivers integrated with control modules is found in the LED lighting industry. For instance, as incandescent including halogen lightbulbs are now largely banned in regions of the world such as Europe, the importance of LEDs, which will replace them, vastly increases; therefore, the importance of how LEDs are controlled using drivers and control modules also increases. Improving the way in which control modules are able to communicate with drivers encourages use of LEDs by the lighting industry and provides an ideal replacement to conventional incandescent including halogen lightbulbs as they become prohibited.

Any small change in line voltage produces a large change in current, thereby producing an undesirable large change in the brightness of an LED. LEDs are, therefore, best driven in a constant current topology, and drivers function to protect LEDs against fluctuation in line-voltage during operation. In addition, because LED electrical properties change with temperature fluctuations, the driver regulates and maintains a constant amount of current. LEDs require a driver that can convert incoming AC power to a more suitable DC power. Typically, a driver converts 120V 60 Hz AC power to a low-voltage DC power required by LEDs.

The driver is integrated with a control module which provides it with instructions to execute and drive, for instance, the LED. Most LED drivers use either 0-10V analog input signals or digital signals compliant with DALI standards to control the output current to the LED. Integration of wireless control into the driver is advantageous, but for every wireless communication protocol, and every provider's unique firmware and software interface, a unique driver is required. Such a coupling of control modules associated with unique drivers is both expensive to manufacture and complicated in design.

The present invention intends to address and/or overcome the limitations discussed above by presenting new designs and method not hitherto contemplated nor possible by known constructions. More particularly, the invention intends to improve the communication between drivers and control modules so that their expense to manufacture may be reduced and their design may be simplified.

SUMMARY OF THE INVENTION

In an aspect of the present invention, there is provided a system including a driver and a control module, the control module capable of translating a received control signal having a first control scheme into a driver control signal having a second control scheme, where that second control scheme is predetermined; and where the driver is configured for generating a driver output based on the identity of the first control scheme and the driver control signal. The control module may be configured to identify the first control scheme and output to the driver an analog signal, such as an identity voltage, associated with that particular first control scheme.

In this application, a control scheme may be understood as a control protocol such as a Wi-Fi protocol or Zigbee protocol. Therefore, a first control scheme may be, for instance, a Wi-Fi protocol and the predetermined second control scheme may be a Pulse Width Modulated protocol. Having a "predetermined" second control scheme ensures that the driver always receives a control scheme that it recognizes and with which it is compatible irrespective of the first control scheme. From this follows the capability of the control module to translate (convert) the received control signal from the Wi-Fi protocol to the Pulse Width Modulated control scheme (for the driver control signal). Therefore, regardless of the identity of the first control scheme—whether this be, for example, Wi-Fi protocol A, Wi-Fi protocol B, Zigbee protocol C, 0-10V protocol D, or DALI protocol E—the driver will still be compatible and be able to operate with this information and generate an appropriate driver output based on the identity voltage associated with the first control scheme, and the driver control signal. Consistent with this paragraph, as used in this document, the phrase "predetermined second control scheme" is expressly defined to mean a second control scheme output from the control module that has been predetermined to be uniform (that is, the same) regardless of the identity of the first control scheme received by the control module.

The main significance of the capability of the control module to translate (convert) is that this makes essentially the driver "universal" in that it can function with any control module receiving a control signal having a first control scheme. Therefore, rather than matching every wireless communication protocol and every provider's unique firmware stack and software interface with a unique driver (as discussed above in the background art), a system formed according to the present invention provides a driver that is compatible with a variety of different control modules, since the driver always receives a driver control signal having a predetermined (i.e. common/uniform) second control scheme. In this way, the number of drivers required in any particular application can be significantly reduced. While a control signal having a first control scheme/protocol will still be assigned an individual control module, since it is much less expensive to manufacture control modules than drivers, the overall manufacturing costs for the system can be significantly reduced. In other words, the SKU count of the drivers that need to be supported can be significantly reduced, thereby saving substantial costs. In this way, the size of the system may also be reduced (due to reduced number of driver variants).

An additional reason and advantage for reducing the number of drivers by utilizing the system of the present invention is that it is much more difficult and expensive to achieve UL (Underwriters Laboratories) certification for a driver than it is for a control module. It is well known that UL LLC is a global safety consulting and certification company which issues a UL certification to a product attesting that the product has met its stringent safety and quality standards. Thus, by reducing the number of driver variants, this reduces the overall time and cost associated with obtaining UL approval.

A further advantage of the system of the invention is that it provides the ability to upgrade the control scheme without having to replace a driver, which would otherwise be necessary with known constructions. In the particular application of LEDs, for example, the system is able to simplify the control of LEDs by removing one of the three variants typically present—these are power level, form factor, and control protocol. The system according to the invention relies on the control module being capable of translating the received control protocol to a predetermined protocol, thereby eliminating the "control protocol" variant when controlling LEDs. This simplification means that manufacturers need only consider the power level and form factor when deciding how to the control LEDs using the system. Not only is time saved in this manner, but costs are also reduced. For example, typical configurations for LED drivers is shown in Table 1. It will be appreciated that the combinations of three variants is significantly greater than the combination of two variants, resulting in six different driver variants. Therefore, the elimination of the "control protocol" variant when controlling LEDs means that manufacturers/consumers need only consider the power level and form factor when deciding how to the control LEDs using the system of the present invention. This results in only two driver variants

TABLE 1

| LED Driver Variants | | |
|---|---|---|
| Power Level (W) | Form Factor | Control Protocol |
| 30 W | Brick | 0-10 V |
| 30 W | Brick | DALI |
| 30 W | Brick | DMX |
| 75 W | Linear | 0-10 V |
| 75 W | Linear | DALI |
| 75 W | Linear | DMX |

The control module may comprise a micro control unit for identifying the first control scheme. One way the control module can identify the first control scheme is for the control module to comprise a micro control unit. This may process the information it receives from the control signal and aid transmission of the driver control signal. A micro control unit may be more cost effective and smaller in size than a typical microprocessor.

The first control scheme may be different from the predetermined second control scheme. For example, the first control scheme may be a 0-10V control protocol and the predetermined second control scheme may be a Zigbee control protocol. Thus, the control module is capable of translating (converting) a received control signal having the 0-10V control protocol into a driver control signal having the Zigbee control protocol.

It may be that when the scheme of the received control signal is the same as that of the driver control signal, the control module is configured directly to transmit the received control signal to the driver. Should the first control scheme and predetermined second control scheme be the same, for instance, translation (conversion) by the control module is not necessary and the driver control signal may be transmitted in the same form as it was received by the control module.

The received control signal may be transmitted to the control module from an external control device such as for example a PC, tablet, phone, application, Bluetooth or Wi-Fi wall switch, IoT enabled devices, or remote control. Of course, it will be appreciated that there may be other external control devices that are equally suitable and equipped to transmit the control signal. The variety of different external control devices that are able to transmit the control signal to the control module lends versatility to the system according to the present invention. A feature of the system is that regardless of the form of the control signal being transmitted by an external control device (whether this is Wi-Fi or Bluetooth for example), the control signal having a Wi-Fi/Bluetooth control scheme can be translated into a driver control signal having a predetermined second control scheme by the control module allowing it to communicate effectively with the driver.

The control module may be configured to identify the first control scheme and output to the driver an identity voltage associated with that particular first control scheme. Such a configuration is effective because the identity voltage may be specific to a control protocol and this identity voltage can eventually be used by the driver to generate the driver output. The driver may be configured to determine the identity of the first control scheme from the identity voltage. The driver may comprise firmware for generating the driver output based on the identity voltage and the driver control signal. The firmware may comprise a lookup table. The lookup table may be operable to generate the driver output by correlating the information from the identity voltage and the driver control signal.

It may be that the identity voltage is generated within a voltage range. For example, the voltage range may be selected from 0.9-1.1V, 1.1-1.3V, or 1.3-1.5V, where the voltage range 0.9-1.1V may denote Wi-Fi protocol A, and voltage range 1.3-1.5V may denote Zigbee protocol C.

The driver may comprise 2 to 6 channels. A benefit of the driver having multiple channels is that it enhances its functionality and versatility—enabling it to drive more types of devices. The channels may be independently controllable. It may be that the channels are LED channels. In this way, the system may be configured for dimming, white point tuning or color tuning LEDs.

Typically, the driver and control module may be physically located on separate circuit boards (substrates). By separating the driver and control module, the additional circuitry normally present for the control module may be moved to a separate circuit board thereby potentially improving the reliability of the driver. This may particularly be the case for a multi-channel driver involving more circuitry. It may be that the driver and control module are provided as part of a turn-key system which minimizes physical space requirements and also provides an electrical connection scheme between the driver and the control module that is both inexpensive and robust.

The driver may comprise a micro control unit that controls the behavior of the driver output by applying logical processing based on the driver control signal and the identity voltage. For instance, if the predetermined second control scheme comprises 0-10V, the micro control unit applies 0V to a driver via the driver control signal, and the driver may turn off the output to what is being controlled (an LED for example). Alternatively, if the micro control unit applies 5V to a driver via the driver control signal, the driver may set the output to 50% of the output current of what is being controlled (an LED for example).

The control module micro control unit may be operable to communicate directly with the driver micro control unit to control the driver output characteristics. Such a configuration may improve the efficiency of the system due to the direct communication between the respective micro control units of the driver and the control module using their native signals, for instance native digital signals.

The predetermined second control scheme may be Pulse Width Modulated. More particularly, it may be a low voltage, high frequency pulse width modulated (PWM) control scheme. When using a PWM control scheme, a duty cycle of 100% used to set the driver output to its maximum value; if duty cycle is 50% it might set the driver output to 50% of its maximum value; and if duty cycle is 0% it can switch off the driver output so that no current flows through the LEDs. With further regard to LEDs, this may involve a PWM dimming input for the driver. PWM is particularly effective for multi-channel drivers involving white point tuning or full color tuning, and also wireless control. Since the majority of existing/future control modules are/will be wireless, PWM advantageously lends itself to this technology. Further, since PWM signals may be read on digital GPIO (General Purpose Input Output) pins, they may be reassigned to perform other functions such as sensor communication, data transmission (IoT Ready power metering), communication devices including a smoke detector or fire alarm for example. The number of PWM signals may be from one to five, for example, to support multi-channel applications from simple dimming, two-channel white point tuning, and Red, Green, Blue, Warm White and Cool White full color tuning.

The predetermined second control scheme may be selected from 0-10V, DALI, Wi-Fi, Zigbee, Thread, DMX 512, and Bluetooth. Of course, other predetermined control schemes may be selected which are equally effective in the system defined herein.

The driver output may be a constant current. This may be particularly beneficial in LED lighting applications.

The driver and the control module may be electrically connected by wires. An electrical connection by wires may provide a more robust and reliable connection.

In the application of LEDs in particular, as the number of electrical connections grow as the number of LED channels, for example, is increased in order to implement features such as white point or full color tuning, this additional wiring increases the risk of incorrectly wiring the system during fabrication of such a lighting fixture. It is also possible that a connection of this type may fail during transportation or installation of such a lighting fixture. To prevent damage or failure of the lighting fixture, its components or surroundings, a CAT5 cable may be utilized which normally comprises eight wires which is generally sufficient to carry power to the control module and multiple signals (such as PWM) for white point or color tuning. The driver and the control module may be electrically connected by wires comprising a CAT5 cable. The CAT5 cable may be plenum rated for use in installation of lighting fixtures in plenums of building spaces.

The driver and the control module may be electrically connected by wires comprising a keyed and/or locked connector such as for example a RJ45 connector. The wires may be cables terminated with RJ45 connectors. To prevent damage or failure of the lighting fixture, its components or surroundings, a RJ45 connector may be utilized which normally comprises eight pathways which is generally sufficient to carry power to the control module and multiple signals (such as PWM) for white point or color tuning. The RJ45 connector may be installed in one orientation and locks into place within a receptacle of the control module or driver, thereby providing a robust and reliable connection between the control module and the driver. The RJ45 connector may carry auxiliary power to power external devices. Further, the RJ45 connector/interface may be split up at one end thereof to attach multiple devices to a single driver.

The control module may comprise firmware for translating the received control signal having a first control scheme into a driver control signal having a predetermined second control scheme. In this way, the firmware may efficiently translate/convert the signal.

The control module may comprise firmware for identifying the first control scheme. Once established by the firmware, the identity of the first control scheme may be made available to the driver, such as by outputting an identity voltage within a specific voltage range to the driver. For example, as set forth above, an identity voltage in the range 0.9-1.1V may denote that the first control scheme is Wi-Fi protocol.

The system described herein may be used in controlling LEDs. The system is particularly useful in controlling LEDs, and particularly by use of a PWM input to the driver.

The system described herein may be used in white point tuning or color tuning of LEDs.

In another aspect of the present invention, there is encompassed a system comprising a driver and a control module, the control module capable of translating a received control signal having a first control scheme into a pulse width modulated driver control signal, and configured to transmit the pulse width modulated driver control signal and the identity voltage associated with the first control scheme to the driver; and wherein the driver is configured for generating a driver output based on the identity voltage associated with the first control scheme and the pulse width modulated driver control signal.

In a further aspect of the present invention, there is envisaged a control module capable of translating a received control signal having a first control scheme into a pulse width modulated driver control signal, and configured to transmit the pulse width modulated driver control signal and the identity voltage associated with the first control scheme to a driver.

In another aspect of the present invention, there is contemplated a driver configured for receiving a pulse width modulated driver control signal translated from a control signal having a first control scheme; and configured for generating a driver output based on the identity voltage associated with the first control scheme and the pulse width modulated driver control signal.

In a further aspect, the present invention envisages a system comprising a driver and a control module, the control module capable of translating a received control signal having a first control scheme into a plurality of pulse width modulated driver control signals, and configured to transmit the plurality of pulse width modulated driver control signals and the identity voltage associated with the first control scheme to the driver; and wherein the driver is configured for generating a plurality of driver outputs based on the identity voltage associated with the first control scheme and the plurality of pulse width modulated driver control signals.

In another aspect, the present invention encompasses a control module capable of translating a received control signal having a first control scheme into a plurality of pulse width modulated driver control signals, and configured to transmit the plurality of pulse width modulated driver control signals and the identity voltage associated with the first control scheme to a driver.

In another aspect, the present invention contemplates a driver configured for receiving a plurality of pulse width modulated driver control signals translated from a control signal having a first control scheme; and configured for generating a plurality of driver outputs based on the identity voltage associated with the first control scheme and the plurality of pulse width modulated driver control signals.

In a further aspect of the present invention, there is provided a method of controlling an LED system, the method comprising the steps of: providing a control module and LED driver, the control module being capable of translating a received control signal having a first control scheme into a pulse width modulated driver control signal, transmitting the pulse width modulated driver control signal and the identity voltage associated with the first control scheme to the LED driver; and generating an LED driver output based on the identity voltage associated with the first control scheme and the pulse width modulated driver control signal.

In another aspect of the present invention, there is encompassed a method of controlling a multi-channel LED system, the method comprising the steps of: providing a control module and LED driver, the control module being capable of translating a received control signal having a first control scheme into a plurality of pulse width modulated driver control signals, transmitting the plurality of pulse width modulated driver control signals and the identity voltage to the LED driver; and generating a plurality of LED driver outputs based on the identity voltage associated with the first control scheme and the plurality of pulse width modulated driver control signals.

In a further aspect, the present invention provides a system comprising a control module, the control module comprising: an input for receiving a control signal including a first control scheme; a processor capable of translating the control signal into a driver control signal having a predetermined second control protocol scheme; and an output for sending the driver control signal to a driver.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE INVENTION

Figure 1:
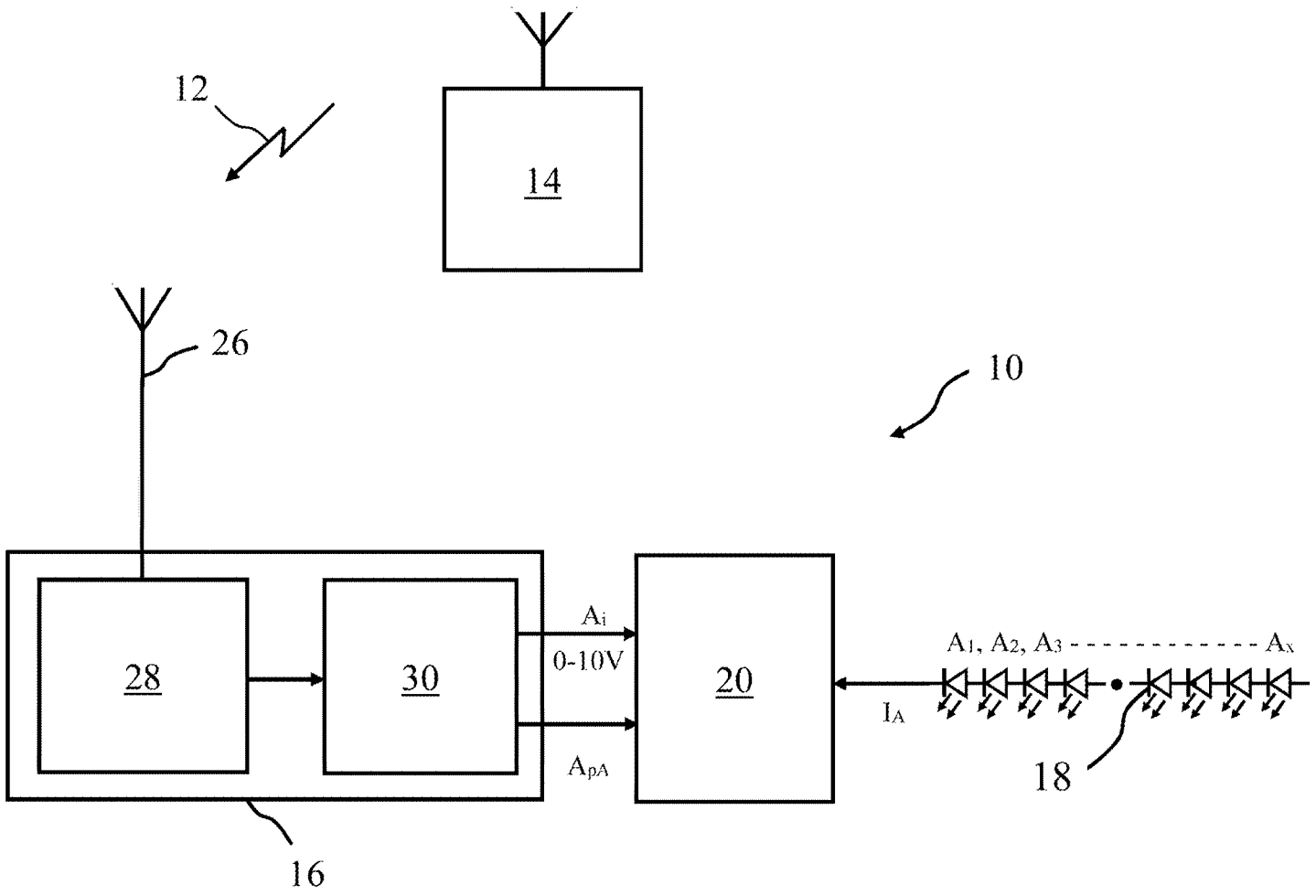
FIG. 1 is a block diagram of a wirelessly controllable LED module comprising a single channel system according to an embodiment of the invention.

Embodiments of the present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration. Throughout this specification like reference numerals are used to denote like parts.

Referring to FIG. 1, there is shown a block diagram of a wirelessly controllable lighting module comprising a single-channel system 10 according to an embodiment of the invention. The brightness (dimming level) of light generated by the lighting module comprising a system 10 can be wirelessly controlled in response to a wireless control signal 12 having a Wi-Fi control scheme received from a remote control device 14. The remote control device 14 device can comprise a dedicated controller such as a handset or may be a cell phone or Wi-Fi enabled device.

The system 10 comprises a control module 16 and a single channel LED driver 20. The system 10 is used to adjust the power level/dim an LED array 18 comprising a plurality, x, of LEDs designated $A_1 \ldots A_x$ that generate light of a given color/color temperature. The LED driver 20 operates (drives) the LEDs $A_1 \ldots A_x$. As indicated in FIG. 1, the plurality of LEDs can be serially connected, though it will be appreciated that they can be connected in other configurations.

The control module 16 comprises an antenna 26 for receiving the wireless control signal 12 having a Wi-Fi control scheme from the remote control device 14; a transceiver 28; and controller logic 30 for generating a driver control signal (including $A_i$ and $A_{pA}$) for operating the LED driver 20 in response to the received control signal 12. In this embodiment, the driver control signal includes a predetermined control scheme comprising PWM. Therefore, the control module 16 is capable of translating the received control signal 12 having a Wi-Fi control scheme into the driver control signal having the predetermined PWM control scheme. The controller logic 30 includes firmware/software and outputs a driver control signal having two parts $A_i$ and $A_{pA}$ that are input directly to the LED driver 20. For instance, $A_i$ may be the identity voltage associated with the Wi-Fi control scheme, while $A_{pA}$ may be the power level associated with the predetermined PWM control scheme.

The LED driver 20 is configured for generating a driver output (constant-current) $I_A$ based on the identity voltage associated with the Wi-Fi control scheme and the driver control signal. The operation of the LED driver 20 is further described with reference to FIG. 2.

Figure 2:
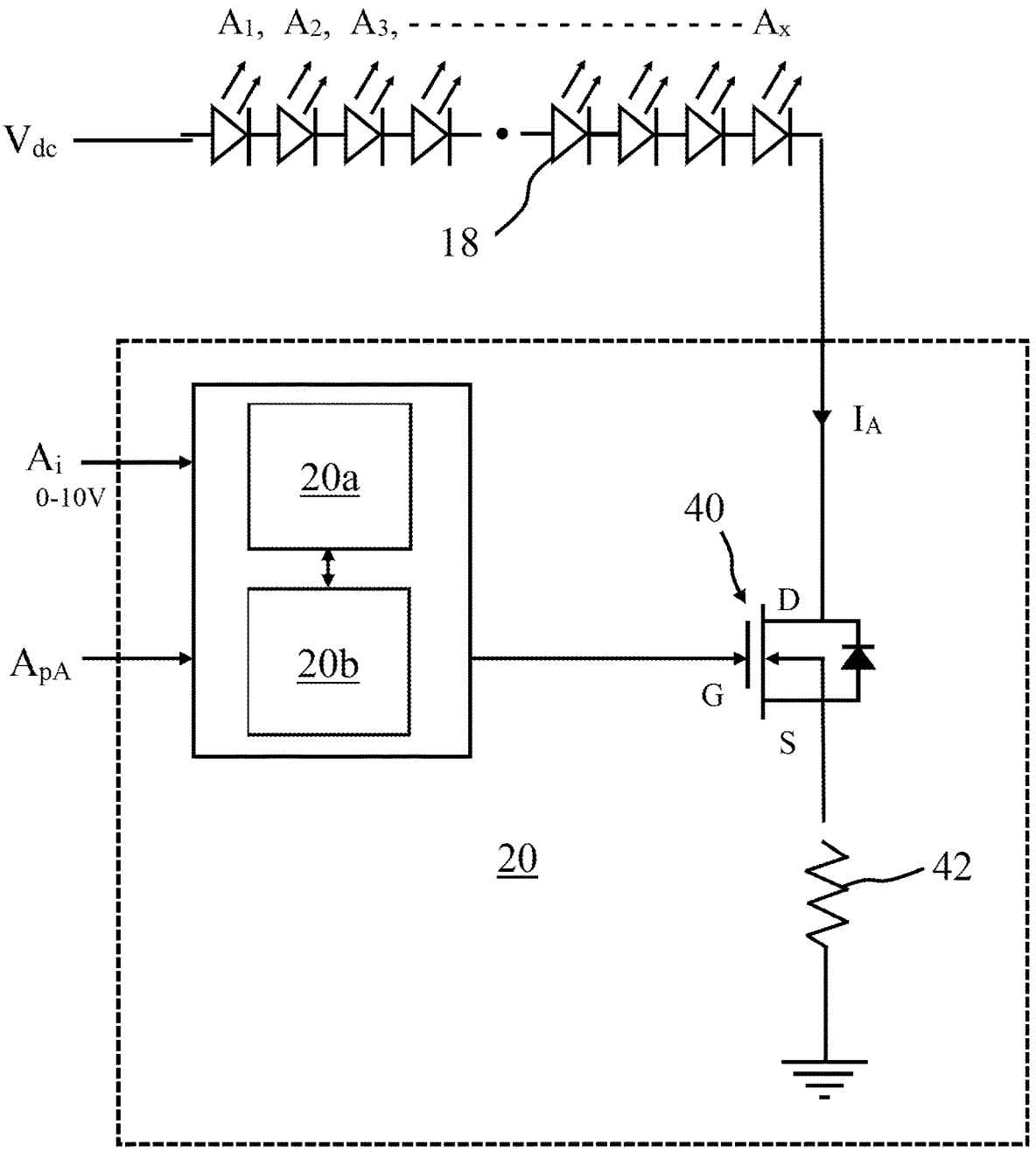
FIG. 2 is a block diagram of a single channel LED driver.

FIG. 2 shows a block/circuit diagram of the LED driver 20 of FIG. 1. The LED driver 20 can be considered a "linear"

driver (linear power regulator). In this specification, a "linear" power regulator/driver is defined as a power regulator that operates in a current control mode and produces a driver output $I_A$ (constant-current output). A linear regulator is to be contrasted with a "switching" regulator that operates in a constant power control mode (e.g. a switch mode power supply) that produces a switched (modulated) output current.

The LED driver 20 receives the driver control signal having two parts $A_i$ and $A_{pA}$ from the control module 16. As indicated in FIG. 2, the driver control signal $A_i$ can be a separate analog control signal having a value of between 0 and 10V. The LED driver 20 comprises a micro control unit 20*a* for identifying the Wi-Fi control scheme. More particularly, the LED driver 20 is configured to identify the Wi-Fi control scheme from the voltage of the driver control signal $A_i$, wherein the voltage of the driver control signal $A_i$ has a voltage range selected from 0.9-1.1V, 1.1-1.3V, 1.3-1.5V . . . 9.8-10V.

The LED driver 20 comprises firmware 20*b* in the form of a lookup table. The lookup table is operable to generate the driver output $I_A$ by correlating the information from the identity voltage associated with the Wi-Fi control scheme $A_i$ and the driver control signal $A_{pA}$. In this way, the micro control unit 20*a* and the firmware 20*b* in the form of a lookup table control the behavior of the driver output $I_A$ by applying logical processing based on the identity voltage associated with the Wi-Fi control scheme $A_i$ and the duty cycle of the driver control signal $A_{pA}$.

The LED driver 20 also comprises a MOSFET 40. The LED driver 20 applies a voltage to the gate, G, of the MOSFET 40 to set the constant-current driver output $I_A$ passing through the MOSFET and LEDs $A_1$ to $A_x$ to an appropriate value. For example, if the duty cycle of $A_{pA}$ is 100% the control logic will set the constant-current driver output $I_A$ to its maximum value, if duty cycle of $A_{pA}$ is 50% it might set the constant current-current driver output $I_A$ to 50% of its maximum value and if duty cycle of $A_{pA}$ is 0% it will switch off the MOSFET 40 so that no current flows through the LEDs $A_1$ to $A_x$. The maximum value of the constant-current driver output $I_A$ that the LED driver 20 can generate can be set by a resistor 42 connected between ground and the source, S, of the MOSFET 40.

In a particular embodiment (not shown), the LED driver 20 and the control module 16 are electrically connected by wires comprising a CAT5 Cable and/or an RJ45 Connector. Moreover, the RJ45 Connector is keyed and/or locked.

Figure 3:
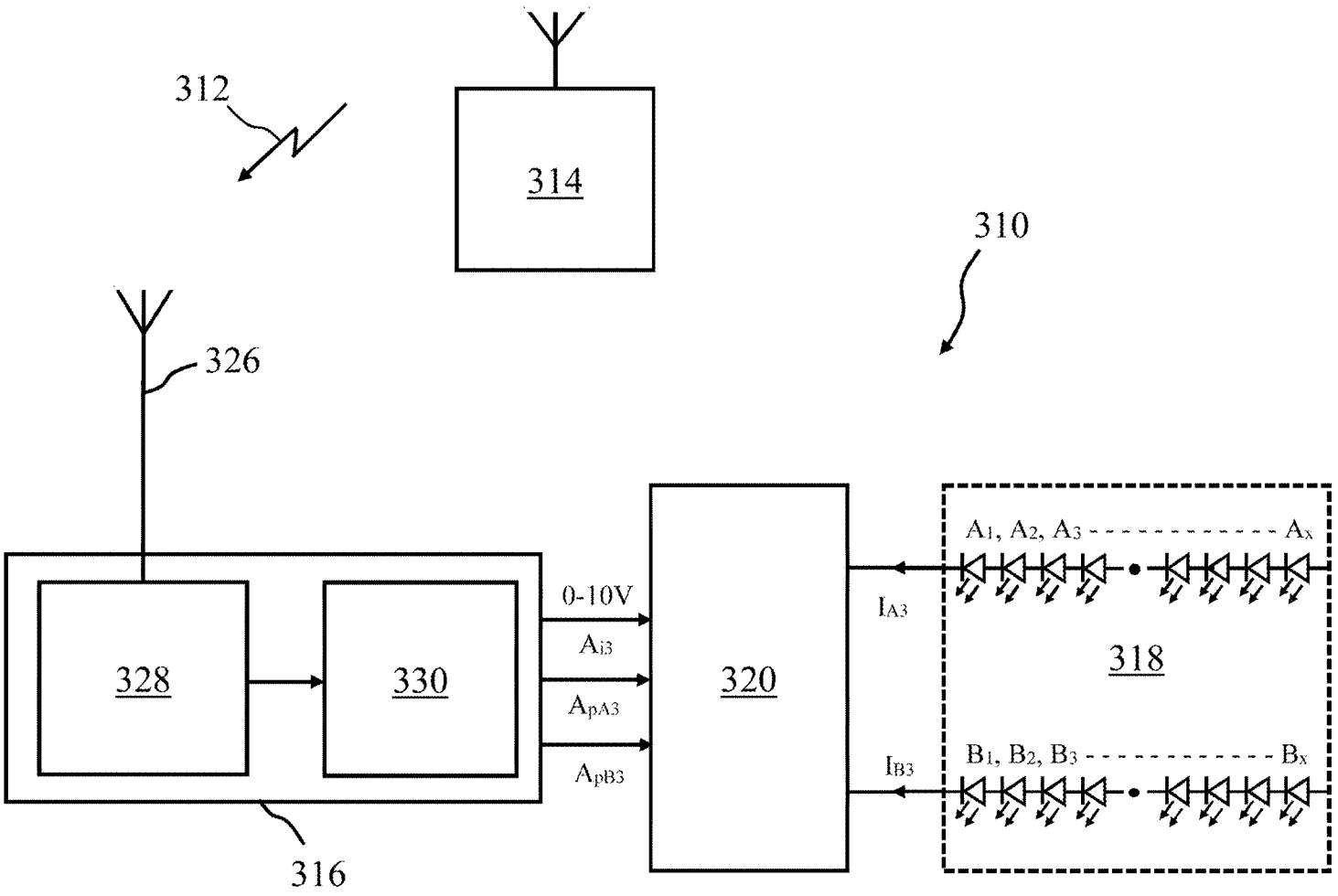
FIG. 3 is a block diagram of a wirelessly controllable LED module comprising a two-channel system according to another embodiment of the invention.

Referring now to FIG. 3, there is shown a block diagram of a wirelessly controllable lighting module comprising a multi-channel (2-channel) system 310 according to another embodiment of the invention.

The color/color temperature and/or brightness (dimming level) of light generated by the system 310 can be wirelessly controlled in response to a wireless control signal 312 having a Bluetooth control scheme received from, for example, a remote wall switch 14.

The system 310 comprises a control module 16; a two-color LED array 318 comprising a plurality, x, of first LEDs designated $A_1 \ldots A_x$ that generate light of a first color/color temperature and a plurality, y, of second LEDs designated $B_1 \ldots B_y$ that generate light of a second color/color temperature; and a multi-channel (2-channel) LED driver 320 for operating (driving) the first LEDs $A_1 \ldots A_x$ and the second LEDs $B_1 \ldots B_x$. As indicated in FIG. 3, the plurality of first and second LEDs can be serially connected, though it will be appreciated that they can be connected in other configurations.

The control module 316 comprises an antenna 326 for receiving the wireless control signal 312 having a Bluetooth control scheme from the wall switch 314; a transceiver 328; and controller logic 330 for generating a control signal (including $A_{i3}$, $A_{pA3}$ and $A_{pB3}$) for operating the LED driver 320 in response to the received control signal 312. In this embodiment, the driver control signal has a predetermined DALI control scheme. Therefore, the control module 316 is capable of translating the received control signal 312 having a Bluetooth control scheme into the driver control signal having the predetermined DALI control scheme. The controller logic 330 includes firmware/software and outputs a driver control signal having three parts $A_{i3}$, $A_{pA3}$ and $A_{pB3}$ that are input directly to the LED driver 320. For instance, $A_{i3}$ may be the identity voltage associated with the Bluetooth control scheme, while $A_{pA3}$ may be the first channel power level associated with the predetermined DALI control scheme and $A_{pB3}$ may be the second channel power level associated with the predetermined DALI control scheme.

The LED driver 320 is configured for generating driver outputs $I_{A3}$ and $I_{B3}$, for controlling first LEDs $A_1 \ldots A_x$ and second LEDs $B_1 \ldots B_x$ respectively, based on the identity voltage associated with the Bluetooth control scheme and the driver control signal. The operation of the LED driver 320 is further described with reference to FIG. 4.

Figure 4:
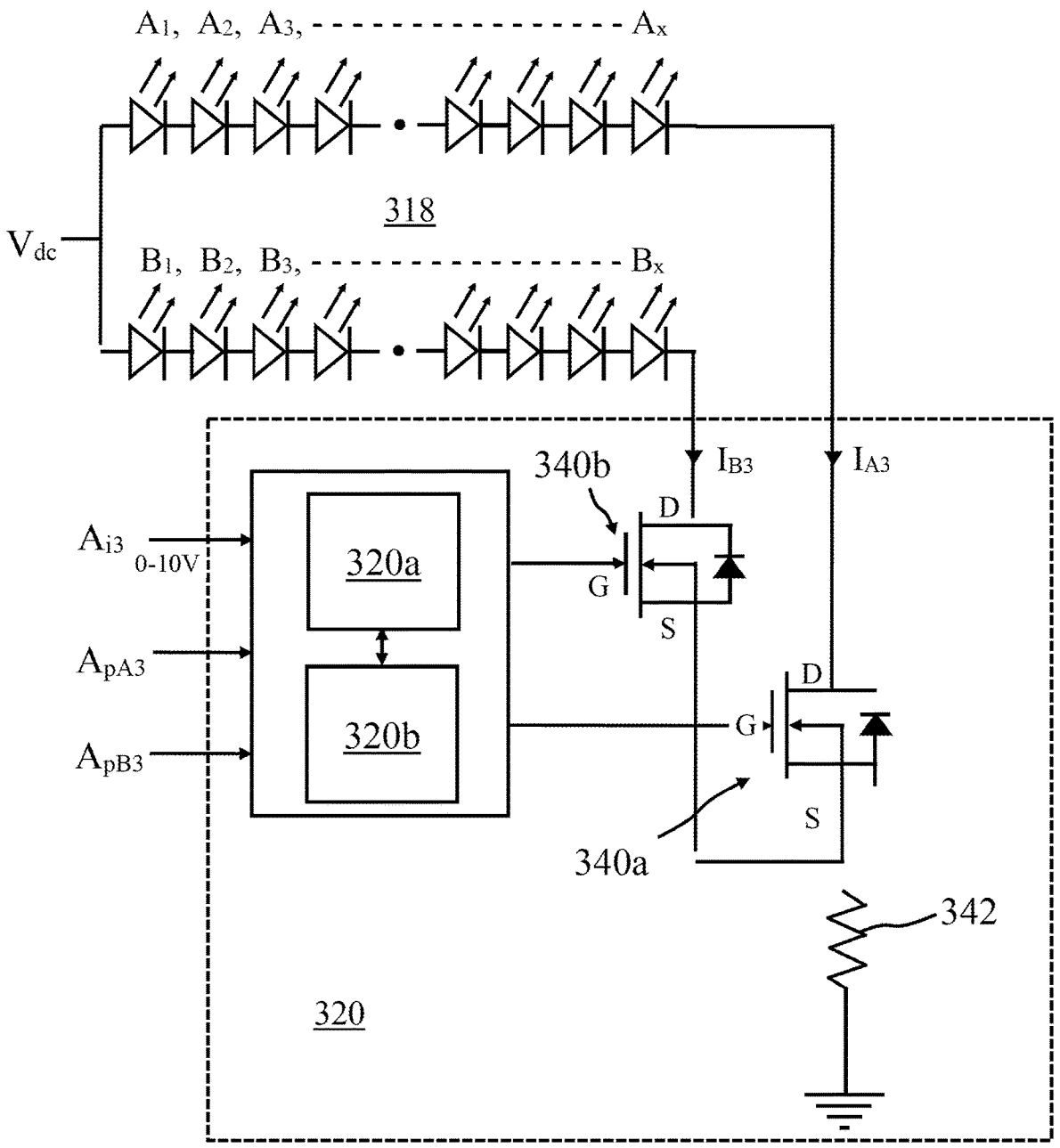
FIG. 4 is a block diagram of a multi-channel LED driver.

FIG. 4 shows a block/circuit diagram of the multi-channel (2-channel) LED driver 320 of FIG. 3. The LED driver 320 receives the driver control signal having three parts $A_{i3}$, $A_{pA3}$ and $A_{pB3}$ from the control module 316. As indicated in FIG. 4, the driver control signal $A_{i3}$ can be an analog control signal having a value of between 0 and 10V. The LED driver 320 comprises a micro control unit 320*a* for identifying the Bluetooth control scheme. More particularly, the LED driver 320 is configured to identify the Bluetooth control scheme from the voltage of the driver control signal $A_{i3}$, wherein the voltage of the driver control signal $A_{i3}$ has a voltage range selected from 0.9-1.1V, 1.1-1.3V, 1.3-1.5V . . . 9.8-10V.

The LED driver 320 comprises firmware 320*b* in the form of a lookup table. The lookup table is operable to generate the driver outputs (constant currents) $I_A$ and $I_B$ by correlating the information from the identity voltage associated with the Bluetooth control scheme $A_{i3}$ and the driver control signals $A_{pA3}$ and $A_{pA3}$. In this way, the micro control unit 320*a* and the firmware 320*b* in the form of a lookup table control the behavior of the driver outputs $I_A$ and $I_B$ by applying logical processing based on the identity voltage associated with the Bluetooth control scheme $A_{i3}$ and the driver control signal $A_{p3}$.

The LED driver 320 also comprises MOSFETS 340*a* and 340*b*. The LED driver 320 applies a voltage to the gate, G, of the MOSFET 340*a* to set the constant-current driver output $I_A$ passing through the MOSFET and first LEDs $A_1 \ldots A_x$ to an appropriate value. Similarly, the LED driver 320 applies a voltage to the gate, G, of the MOSFET 340*b* to set the constant-current driver output Is passing through the MOSFET and second LEDs $B_1 \ldots B_x$ to an appropriate value. The maximum value of the constant-current driver output $I_A$ that the driver 320 can generate can be set by a resistor 342 connected between ground and the source, S, of the MOSFETS 340*a*, 340*b*.

The first LEDs $A_1 \ldots A_x$ and second LEDs $B_1 \ldots B_x$ can generate white light of different CCTs (Correlated Color Temperature). Such an arrangement enables light generated by the LED module to be controlled between the two color temperatures and color temperatures therebetween. For example, the first LEDs may generate Cool White (CW) light, and the second LEDs may generate Warm White (WW) light enabling control of light generated by the LED module between WW and CW and color temperatures therebetween. In this patent specification, Cool White is defined as white light having a CCT (Correlated Color Temperature) of between about 4500K to about 6000K and Warm White is defined as white light having a CCT of between about 2700K to about 4000K. More particularly, the first LEDs can generate Cool White light having a color temperature of 5000K to 5500K and the second LEDs generate Warm White light having a color temperature of 2700K to 3000K.

Figure 5:
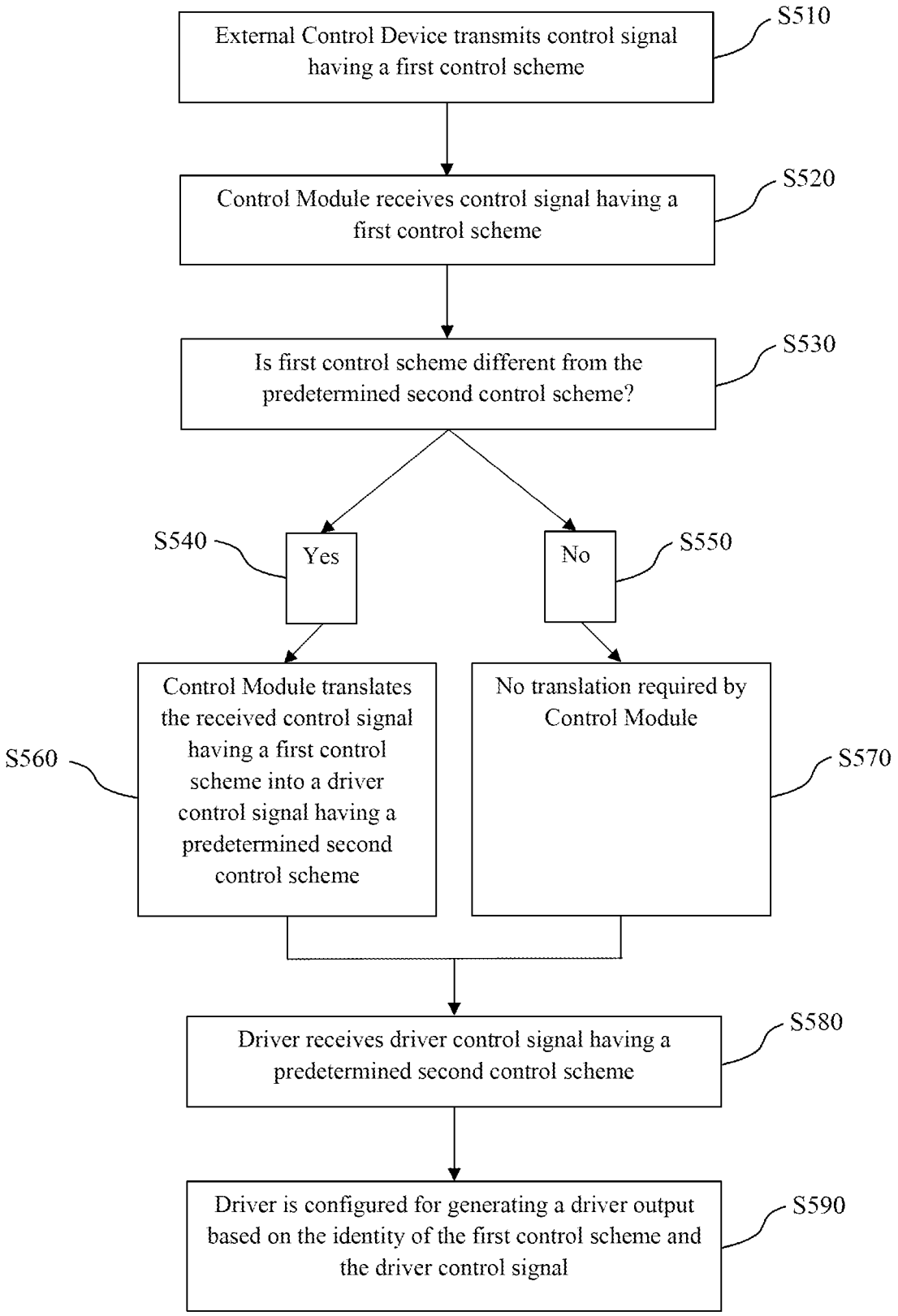
FIG. 5 is an exemplary method of operation of a system formed in accordance with an embodiment of the invention.

FIG. 5 shows an exemplary method of operation of a system formed in accordance with an embodiment of the invention. In FIG. 5, an External Control Device transmits a control signal having a first control scheme at S510. The External Control Device may be selected from a PC, tablet, phone, application, Bluetooth or Wi-Fi wall switch, IoT enabled devices, or remote control, for example. The first control scheme may be a control protocol selected from Pulse Width Modulated, 0-10V, DALI, Wi-Fi, Zigbee, Thread, DMX 512, or Bluetooth, for example.

At S520, a Control Module of the system receives the control signal having a first control scheme from the External Control Device.

At S530, the Control Module establishes whether the first control scheme is different from a predetermined second control scheme. The predetermined second control scheme may be a control protocol selected from Pulse Width Modulated, 0-10V, DALI, Wi-Fi, Zigbee, Thread, DMX 512, or Bluetooth, for example. Having a "predetermined" second control scheme ensures that the Driver always receives a control scheme/protocol that it recognizes and with which it is compatible.

From this follows the capability of the Control Module to translate (convert) the received control signal from the first control scheme to the predetermined second control scheme carried by the driver control signal. Therefore, regardless of the identity of the first control scheme, the driver will still be compatible and be able to operate with this information and generate a driver output based on the identity voltage associated with the first control scheme and the driver control signal. For instance, if the Control Module establishes that the first control scheme is different from the predetermined second control scheme at S540, the Control Module translates the received control signal having a first control scheme into a driver control signal having a predetermined second control scheme at S560, and transmits to the driver an identity voltage associated with the identity of the first control scheme.

The main significance of the capability of the Control Module to translate (convert) is that it makes essentially the driver "universal" in that it can function with any Control Module receiving a control signal having a first control scheme that may be different from the predetermined control scheme. Therefore, rather than matching every wireless communication protocol and every provider's unique firmware stack and software interface with a compatible (unique) driver, a system formed according to the present invention provides a Driver that is compatible with a variety of different Control Modules, since the driver always receives a driver control signal having a predetermined (i.e. common/uniform) second control scheme. In this way, the number of Drivers required can be significantly reduced. While a control signal having a first control scheme/protocol will still be assigned an individual Control Module, since it is much less expensive to manufacture control modules than Drivers—the overall manufacturing costs for the system can be significantly reduced. In other words, the SKU count of the Drivers that need to be supported can be significantly reduced, thereby saving substantial costs. In this way, the size of the system may also be reduced (due to reduced number of Driver variants).

Conversely, for instance, if the Control Module establishes that the first control scheme is the same as the predetermined second control scheme at S550, the Control Module need not translate the received control signal having a first control scheme into a driver control signal having a predetermined second control scheme at S570, since it is already in the predetermined format.

Therefore, regardless of whether or not translation has taken place, the Control Module is able to transmit a driver control signal in the form of the predetermined second control scheme, and an identity voltage associated with the identity of the first control scheme. At S580, the Driver of the system receives the driver control signal having the predetermined second control scheme, and the identity voltage, from the Control Module.

Based on the information the Driver receives from the Control Module, at S590, the Driver is configured for generating a driver output based on the identity voltage associated with the first control scheme and the driver control signal. This allows the system to have utility in applications such as the control and operation of LEDs, fluorescent lamps which have very dynamic electrical resistance and are optimally operated within a short range of currents, shielded metal arc lamps, and gas tungsten arc lamps, which typically require a constant current power supply, for example.

Figure 6:
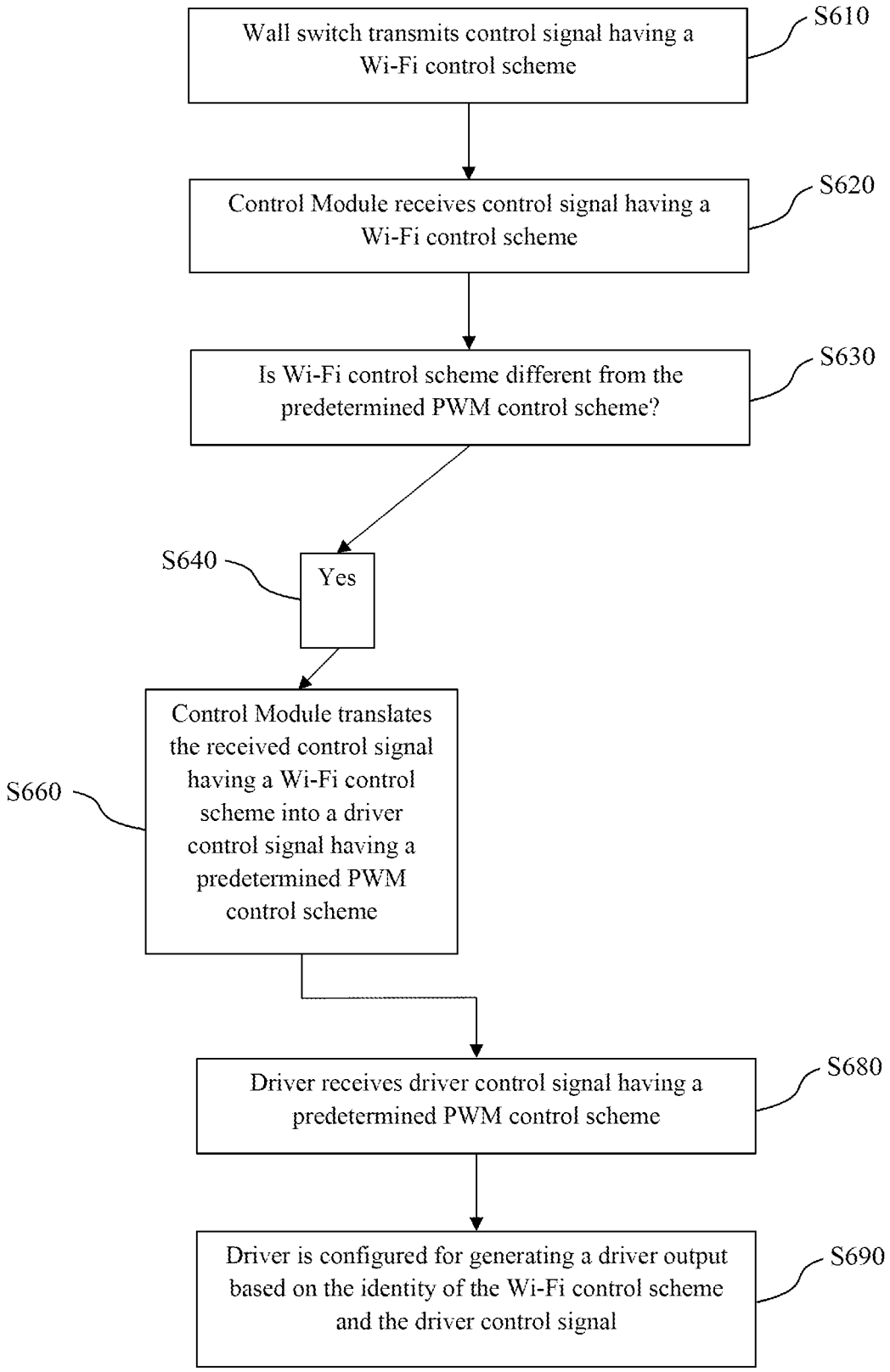
FIG. 6 is an exemplary method of operation of a system formed in accordance with another embodiment of the invention.

Referring now to FIG. 6, there is shown an exemplary method of operation of a system formed in accordance with an embodiment of the invention. In FIG. 6, a Wall Switch transmits a control signal having a Wi-Fi control scheme at S610.

At S620, a Control Module of the system receives the control signal having a Wi-Fi control scheme from the Wall Switch.

At S630, the Control Module establishes whether the Wi-Fi control scheme is different from a predetermined second control scheme. In this embodiment, the predetermined second control scheme is a Pulse Width Modulated control scheme. Having a "predetermined" second control scheme ensures that the Driver always receives a control scheme/protocol that it recognizes and with which it is compatible.

From this follows the capability of the Control Module to translate (convert) the received control signal from the Wi-Fi control scheme to the Pulse Width Modulated control scheme carried by the driver control signal. Therefore, regardless of the identity of the first control scheme—the driver will still be compatible and be able to operate with this information and generate a driver output based on the identity voltage associated with the Wi-Fi control scheme, and the driver control signal. Therefore, in this embodiment, the Control Module establishes that the Wi-Fi control scheme is different from the Pulse Width Modulated control scheme at S640; thus, the Control Module translates the received control signal having a Wi-Fi control scheme into a driver control signal having a Pulse Width Modulated control scheme at S660, and also outputs an identity voltage associated with the identity of the first control scheme.

The main significance of the capability of the Control Module to translate (convert) is that it makes the driver "universal" in that it can function with any Control Module receiving a control signal having a Pulse Width Modulated control scheme, for example. Therefore, rather than matching every wireless communication protocol and every provider's unique firmware stack and software interface with a unique driver, a system formed according to the present invention provides a Driver that is compatible with a variety of different Control Modules, since the driver always receives a driver control signal having a predetermined (i.e. common/uniform) Pulse Width Modulated control scheme, for example. In this way, the number of Drivers required in any particular application can be significantly reduced. While a control signal having a Wi-Fi control scheme/protocol will still be assigned an individual Control Module, since it is much less expensive to manufacture control modules than Drivers—the overall manufacturing costs for the system can be significantly reduced. In other words, the SKU count of the Drivers that need to be supported can be significantly reduced, thereby saving substantial costs. In this way, the size of the system may also be reduced (due to reduced number of Driver variants).

Therefore, regardless of whether or not translation has taken place, the Control Module is able to transmit a driver control signal in the form of the Pulse Width Modulated control scheme. At S680, the Driver of the system receives the driver control signal having the Pulse Width Modulated control scheme from the Control Module.

Based on the information the Driver receives from the Control Module, at S690, the Driver is configured for generating a driver output based on the identity voltage associated with the Wi-Fi control scheme and the driver control signal. In this embodiment, the system controls the emission characteristics of LEDs.

Figure 7:
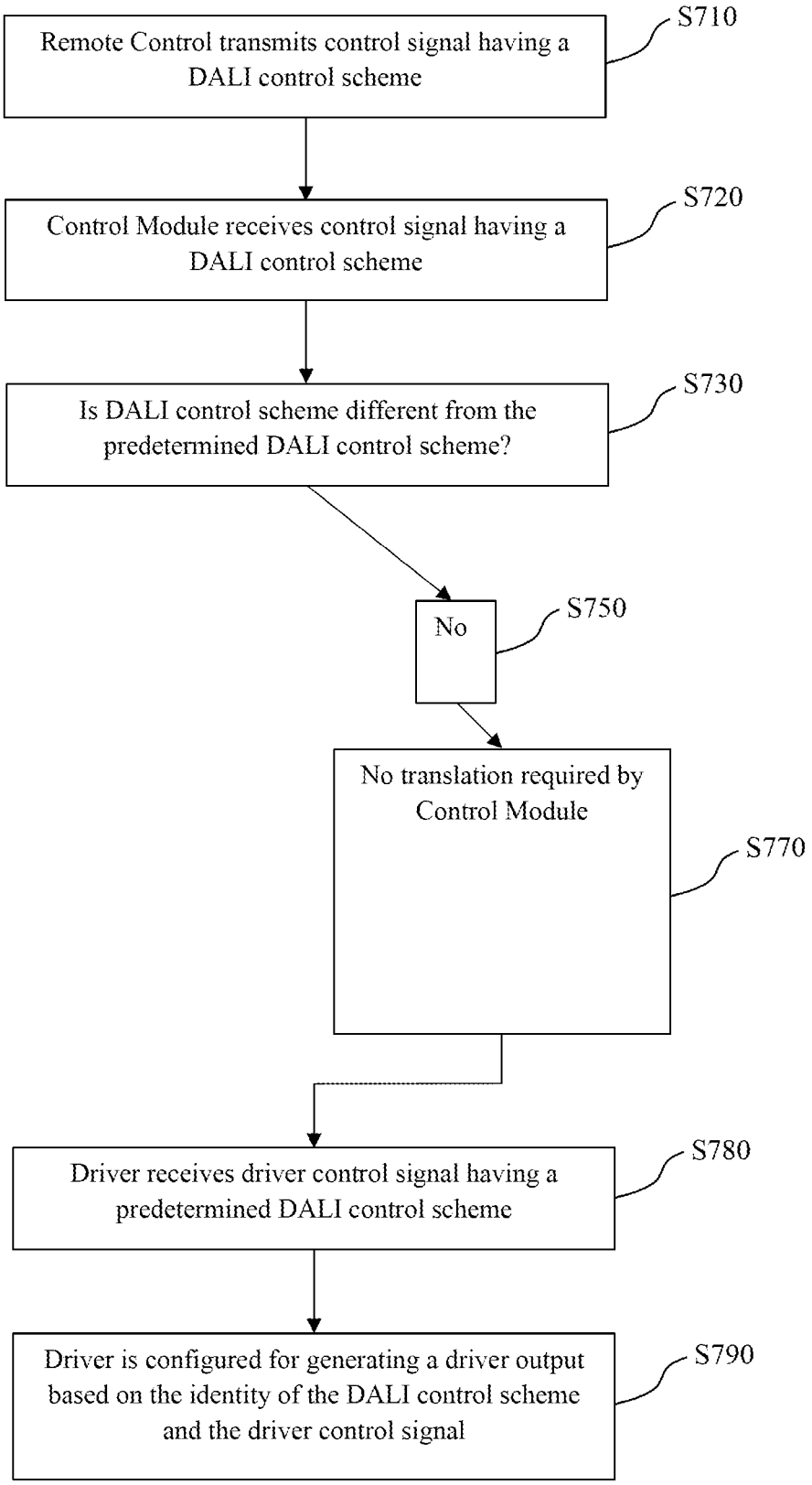
FIG. 7 is an exemplary method of operation of a system formed in accordance with another embodiment of the invention.

Referring now to FIG. 7, there is shown an exemplary method of operation of a system formed in accordance with an embodiment of the invention. In FIG. 7, a Remote Control transmits a control signal having a DALI control scheme at S710.

At S720, a Control Module of the system receives the control signal having a DALI control scheme from the Remote Control.

At S730, the Control Module establishes whether the DALI control scheme is different from a predetermined second control scheme. In this embodiment, the predetermined second control scheme is also a DALI control scheme. Having a "predetermined" second control scheme ensures that the Driver always receives a control scheme/protocol that it recognizes and with which it is compatible.

Therefore, in this embodiment, the Control Module establishes that the Wi-Fi control scheme is the same as the predetermined second (DALI) control scheme at S750; thus, the Control Module need not translate the received control signal having a DALI control scheme into a driver control signal having a predetermined DALI control scheme at S770, since it is already in the predetermined format.

The main significance of the capability of the Control Module to translate (convert) is that it makes essentially the driver "universal" in that it can function with any Control Module receiving a control signal having a DALI control scheme, for example. Therefore, rather than matching every wireless communication protocol and every provider's unique firmware stack and software interface with a unique driver, a system formed according to the present invention provides a Driver that is compatible with a variety of different Control Modules, since the driver always receives a driver control signal having a predetermined (i.e. common/uniform) DALI control scheme, for example. In this way, the number of Drivers required in any particular application can be significantly reduced. While a control signal having a DALI control scheme/protocol will still be assigned an individual Control Module, since it is much less expensive to manufacture control modules than Drivers—the overall manufacturing costs for the system can be significantly reduced. In other words, the SKU count of the Drivers that need to be supported can be significantly reduced, thereby saving substantial costs. In this way, the size of the system may also be reduced (due to reduced number of Driver variants).

Therefore, regardless of whether or not translation has taken place, the Control Module is able to transmit a driver control signal in the form of the DALI control scheme. At S780, the Driver of the system receives the driver control signal having the DALI control scheme from the Control Module.

Based on the information the Driver receives from the Control Module, at S790, the Driver is configured for generating a driver output based on the identity voltage associated with the DALI control scheme and the driver control signal.

As used in this document, both in the description and in the claims, and as customarily used in the art, the words "substantially," "approximately," and similar terms of approximation are used to account for manufacturing tolerances, manufacturing variations, manufacturing and operational imprecisions, and measurement inaccuracy and imprecision that are inescapable parts of fabricating and operating any mechanism or structure in the physical world.

While the invention has been described in detail, it will be apparent to one skilled in the art that various changes and modifications can be made and equivalents employed, without departing from the present invention. It is to be understood that the invention is not limited to the details of construction, the arrangements of components, and/or the method set forth in the above description or illustrated in the drawings. Statements in the abstract of this document, and any summary statements in this document, are merely exemplary; they are not, and cannot be interpreted as, limiting the scope of the claims. Further, the figures are merely exemplary and not limiting. Topical headings and subheadings are for the convenience of the reader only. They should not and cannot be construed to have any substantive significance, meaning or interpretation, and should not and cannot be deemed to indicate that all of the information relating to any particular topic is to be found under or limited to any particular heading or subheading. Therefore, the invention is not to be restricted or limited except in accordance with the following claims and their legal equivalents.

What is claimed is:

1. A method of controlling an LED system with a workpiece control signal having a first control scheme, the method comprising:

providing a lighting module comprising a control module, an LED driver connected to said control module, and at least one LED connected to said LED driver;

receiving, at said control module, the workpiece control signal having a first control scheme;

comparing the first control scheme to a predetermined second control scheme;

when said comparing determines that the first control scheme is the same as said predetermined second control scheme, transmitting to said LED driver a driver control signal comprising said predetermined second control scheme; and when said comparing determines that the first control scheme is different from said predetermined second control scheme, translating, with said control module, the first control scheme into said predetermined second control scheme and then transmitting to said LED driver a driver control signal comprising said predetermined second control scheme.

2. The method of claim 1, further comprising receiving said driver control signal at said LED driver after said transmitting, and in response to said receiving, generating an LED driver output.

3. The method of claim 2, wherein said LED driver operates in a current control mode, and wherein said generating comprises producing a constant-current output.

4. The method of claim 2, further comprising receiving said LED driver output at said one or more LEDs, and dimming at least one said LED in response to said receiving.

5. The method of claim 2, further comprising receiving said LED driver output at said one or more LEDs, and changing the CCT of light output by said lighting module in response to said receiving.

6. The method of claim 1, wherein said LED driver comprises at least one channel, and further comprising performing, for each channel:

said receiving and said comparing; and when said comparing determines that the first control scheme is the same as said predetermined second control scheme, transmitting to said LED driver a driver control signal comprising said predetermined second control scheme;

when said comparing determines that the first control scheme is different from said predetermined second control scheme, translating, with said control module, the first control scheme into said predetermined second control scheme and then transmitting to said LED driver a driver control signal comprising said predetermined second control scheme.

7. The method of claim 6, wherein said driver controls a plurality of first LEDs through a first channel and a plurality of LEDs through a second channel.

8. The method of claim 7, wherein said driver controls at least one property of light emitted by the lighting module by differentially controlling first LEDs and second LEDs.

9. The method of claim 7, wherein said at least one property of light emitted by the lighting module is brightness.

10. The method of claim 7, wherein said at least one property of light emitted by the lighting module is CCT.

11. The method of claim 1, wherein said driver control signal is an analog signal.

12. A method of controlling an LED system with a workpiece control signal having a first control scheme, the method comprising the steps of:

providing a lighting module comprising a control module, an LED driver connected to the control module, said LED driver comprising at least one channel, and at least one LED connected to said LED driver;

receiving, at said control module, the workpiece control signal having a first control scheme;

converting, at said control module, the first control scheme into a predetermined second control scheme, when the first control scheme is different from said predetermined second control scheme;

generating, at said control module, an identity voltage associated with the first control scheme;

transmitting to said LED driver said identity voltage and a driver control signal comprising said predetermined second control scheme.

13. The method of claim 12, further comprising generating an LED driver output based on said identity voltage and said driver control signal.

14. The method of claim 12, wherein said driver control signal is a digital signal.

15. The method of claim 12, wherein said driver control signal is an analog signal having a voltage X, wherein 0 V≤X≤10 V.

16. The method of claim 12, wherein said identity voltage is generated within one of a plurality of different voltage ranges, and wherein each said voltage range is associated with a different said first control scheme.

17. A lighting module that receives a control signal having a first control scheme, comprising:

a driver;

a control module connected to said driver, said control module comprising a transceiver, an antenna connected to said transceiver, said antenna configured to receive the control signal, and controller logic connected to said transceiver;

wherein said controller logic translates the received first control scheme into a predetermined second control scheme, when the first control scheme is different from said predetermined second control scheme;

wherein said controller logic generates an identity voltage correlated with the received first control scheme; and wherein said controller logic outputs to said driver a driver control signal comprising said predetermined second control scheme, and said identity voltage.

18. The lighting module of claim 17, wherein said driver is a multi-channel driver.

19. The lighting module of claim 17, wherein said controller logic comprises a micro control unit.

20. The lighting module of claim 17, wherein said control module is connected to said driver by a wired connection.

* * * * *